United States Patent [19]

Hermanns et al.

[11] Patent Number: 4,805,844

[45] Date of Patent: Feb. 21, 1989

[54] METHOD AND APPARATUS FOR MONITORING AND CONTROLLING WINDING OPERATION OF A WINDING STATION IN A TEXTILE WINDING MACHINE

[75] Inventors: Ferdinand-Josef Hermanns, Erkelenz; Rolf Haasen, Monchen-Gladbach, both of Fed. Rep. of Germany

[73] Assignee: W. Schlafhorst & Co., Monchen-Gladbach, Fed. Rep. of Germany

[21] Appl. No.: 152,782

[22] Filed: Feb. 5, 1988

[30] Foreign Application Priority Data

Feb. 7, 1987 [DE] Fed. Rep. of Germany ..... 3703869

[51] Int. Cl.[4] ..... B65H 54/42; B65H 63/00

[52] U.S. Cl. ..... 242/18 DD; 242/18.1; 242/36

[58] Field of Search ..... 242/18 DD, 18 R, 18.1, 242/36, 45, 37 R, 39

[56] References Cited

U.S. PATENT DOCUMENTS 4,069,985 1/1978 Lohest et al. ..... 242/18 DD
4,447,955 5/1984 Stutz et al. ..... 242/36 X
4,458,849 7/1984 Miyake et al. ..... 242/36
4,548,366 10/1985 Wirz et al. ..... 242/18 DD
4,676,441 6/1987 Maag ..... 242/18.1
4,696,435 9/1987 Hermanns ..... 242/18.1

FOREIGN PATENT DOCUMENTS 0196090 10/1986 European Pat. Off. .
3521152 12/1986 Fed. Rep. of Germany .

*Primary Examiner*—Stanley N. Gilreath
*Attorney, Agent, or Firm*—Shefte, Pinckney & Sawyer

[57] ABSTRACT

In a textile winding machine of the type wherein yarn is cross-wound onto a bobbin peripherally driven by a friction roller, the winding operation may be monitored and controlled to achieve a high winding quality by constantly varying the time period per revolution of the friction roller, constantly measuring the respective time periods per revolution of the bobbin and the roller, at least intermittently comparing the measured revolution time periods, and regulating the friction roller drive or stopping the winding operation altogether or otherwise intervening in the winding operation as a function of deviations of the comparison result from established theoretical values.

28 Claims, 4 Drawing Sheets

FIG. 2
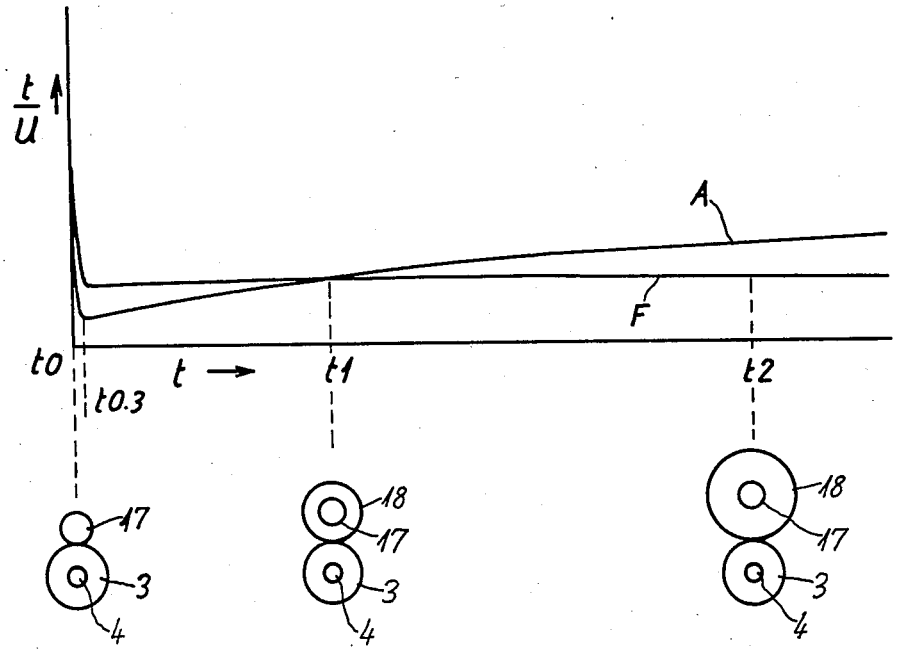
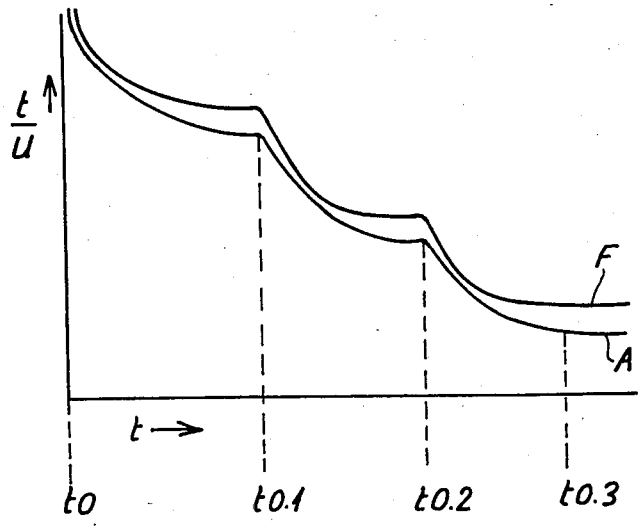
FIG.6

FIG. 4
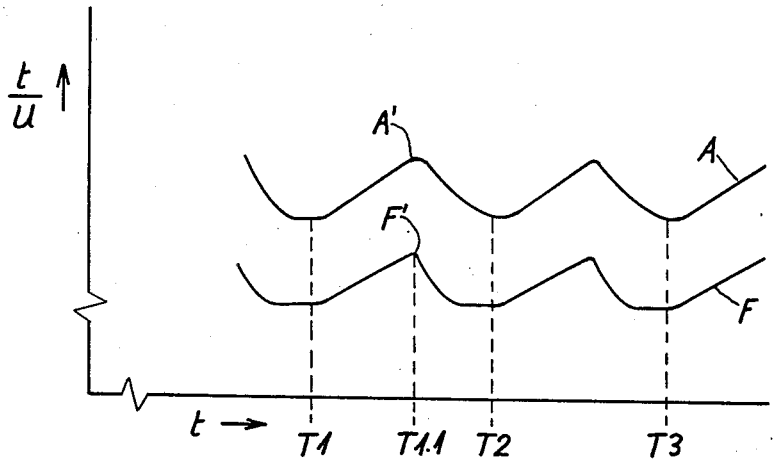
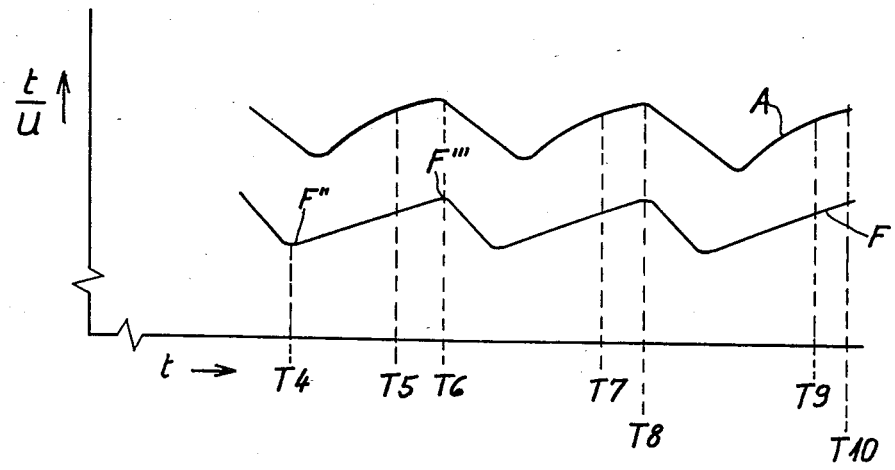
FIG. 5

METHOD AND APPARATUS FOR MONITORING AND CONTROLLING WINDING OPERATION OF A WINDING STATION IN A TEXTILE WINDING MACHINE

BACKGROUND OF THE INVENTION

The present invention relates to a method of monitoring and controlling the winding process in the production of a bobbin at a winding station in a textile winding machine wherein the bobbin is peripherally driven by a driven friction roller. Further, the present invention relates to apparatus for performing the aforementioned monitoring and control method at the winding station of the winding machine, wherein each of the bobbin and friction roller is provided with an associated pulse generator adapted to emit at least one pulse per revolution of the bobbin and friction roller, respectively, and to supply such pulses to an operatively connected electronic calculator or computer for carrying out the aforesaid method.

Winding stations having a friction drive roller are found in conventional textile winding equipment, for example cross bobbin winders and automatic cross bobbin winders, wherein a traveling yarn unwound from a cop or another bobbin is transferred in a cross-wound fashion to a new bobbin. In this equipment, the friction roller often is a grooved yarn guide drum adapted to guide the traveling yarn in a back and forth traverse along the cross-wound bobbin druing the course of the winding process in order to wind the yarn in a cross-wound manner.

Alternatively, instead of utilizing a grooved yarn guide drum for performing the dual functions of yarn traversing and serving as a friction drive roller, it is also known to utilize a separate yarn guide for guiding the yarn in a back and forth traverse along the cross-wound bobbin, with the friction roller accordingly having no yarn guide grooves.

Such winding stations, sometimes referred to as winding heads, are also present in other textile machines, for example, in open-end rotor spinning machines, friction spinning machines, or air spinning machines, in conjunction with their spinning positions in order to make possible the winding of cross-wound bobbins. In such embodiments, the particular spinning position or spinning unit at the spinning work position may be considered a yarn supply comparable to the cop or delivery bobbin in the afore-described cross bobbin winders.

In conventional textile machines of these types, monitoring components are associated with the winding stations to monitor pertinent aspects of the winding process and machine functions and, in some cases, to also function under appropriate circumstances to stop the operation of the winding station. For example, such monitoring components may be stop motions, slub catchers, or other suitable yarn monitoring devices adapted to detect the occurrence of a yarn breakage or other yarn defect or error, to thereupon stop the operation of the winding station, and to actuate an appropriate specialized device for correcting the breakage or error. Another monitoring component or sensor can be adapted to monitor the cumulative length of yarn wound onto the cross-wound bobbin and to actuate stoppage of the winding station when a predetermined yarn length has been reached. The winding station may also be stopped when a pre-set bobbin diameter or weight is reached.

Other monitoring components are used, for example, to prevent the occurrence of so-called "constant pattern windings" by activating and de-activating a so-called anti-patterning device. Still other monitoring devices are utilized to recognize occurrence of yarn windings or wrappings about the friction roller, often called drum windings. Such drum windings may be caused by the occurrence of a yarn breakage at a location along the course of yarn travel at the nip between the friction roller and the bobbin whereupon the broken yarn end may be carried by the friction roller instead of the bobbin and thereby wound onto the roller.

As will be understood, corresponding data detection devices are required for these various monitoring functions carried out at textile winding stations, as well as specialized data processing equipment to indicate appropriate measured values and to control de-activation or switching of steps in the winding process upon certain predetermined occurrences. Disadvantageously, however, a number of various sensors, data detection devices, data processing devices, indicator devices, control devices and the like are required for monitoring and controlling the winding process in accordance with the foregoing.

SUMMARY OF THE INVENTION

It is accordingly an object of the present invention to provide a simple means and method for reliably and effectively monitoring and controlling the winding operation of a textile winding machine while retaining a high winding quality.

The present invention achieves this objective by a method adapted for monitoring and controlling winding operation of a winding station in a textile winding machine of the type wherein a bobbin is rotatably driven by a friction roller in peripheral contact with the bobbin for winding a traveling yarn or other strand about the bobbin. According to the present method, the time period per revolution of the friction roller is essentially constantly varied while constantly measuring the respective time periods per revolution of each of the friction roller and the bobbin and at least intermittently comparing such measured timer periods. Theoretical values are established for the result of such comparison of the time periods per revolution of the friction roller and the bobbin over the course of a winding operation, and the drive of the friction roller is regulated, or the winding operation is intervened in, or the winding station is stopped as a function of deviations in the comparison result from such theoretical values.

Thus, according to the present invention, the winding speed of the winding operation is not constant, although the average value of the winding speed may be constant. Specifically, time intervals of non-constant winding speed may alternate with smaller time intervals of constant winding speed and, in this manner, the present method results in a good mixing of the cross-wound layers of yarn or strand over the course of the entire bobbin winding operation. The comparison of the time periods per revolution of the friction roller and the bobbin may be carried out constantly or intermittently, which provides an indication concerning the quality of the winding process despite the non-uniformity or inconstancy of the bobbin winding speed. Thus, if deviations from the established theoretical values occur, appropriate intervention is made into the winding process.

The result of the comparison between the time periods per revolution of the friction roller and the bobbin may be determined as the sum or the difference or as the product or the quotient of the respective measured revolution time periods. Preferably, a quotient is obtained as the comparison result to serve as an actual value for comparison with the established theoretical values. It is further preferred that the comparison between the time periods per revolution of the friction roller and the bobbin be determined at points in time at which the bobbin is driven at least approximately without slippage with respect to the friction roller.

An electronic calculator or computer is preferably utilized to enable the setting of the theoretical values for the course of a winding operation. According to a further aspect of the present invention, the drive means for the friction roller may be alternately loaded with increased and decreased drive energy or periodically loaded with drive energy, in order to achieve the desired variance in the time periods per revolution of the friction roller. In this manner, at times during which the comparison result remains at least approximately steady while for example while the friction roller is operating with decreased drive energy or without a supply of drive energy, the result of comparison of the time periods per revolution of the friction roller and the bobbin may be utilized as a theoretical value applicable during a following period or periods of variation in the revolution time period of the friction roller.

It is assumed for purposes of the method of the present invention that the winding build-up of yarn or strand on the bobbin does not noticeably increase during a single revolution of the bobbin or even during a number of bobbin revolutions, e.g., 10 to 100 revolutions. If the comparison result of the time periods per revolution of the friction roller and the bobbin remains approximately steady during the winding process, this is an indication that the friction roller and the bobbin are running approximately without slippage with respect to one another. Thus, at this point in time, the actual value of the comparison result of the time periods per revolution of the friction roller and the bobbin may be extracted and thereafter utilized for a subsequent period of time as an applicable theoretical value which correspondinds at this point in time to the actual value of the comparison result. Accordingly, calculating time is saved which enables a smaller calculator to be utilized.

As a result of the non-uniformity or inconstancy of the winding speed, it will be understood that the value of the comparison result does not remain constant. However, it is expected that the comparison result of the measured time periods per revolution of the friction roller and bobbin will deviate from the established theoretical value only within a tolerable range, unless unexpected changes or other events occur in the winding operation. As soon as the comparison result again reaches an at least approximately steady value, this new comparison result is thereafter utilized as the applicable theoretical value for a following period of the winding operation, this manner of operation continuing until the completion of the overall bobbin winding operation.

In accordance with another feature of the present invention, a command may be emitted to stop the operation of the winding station and to separate the winding bobbin from the friction roller at any point in time at which the comparison result of the revolution times is at least approximately steady and at the same time has reached a predetermined final value indicating that the desired bobbin fullness and diameter have been reached.

A further feature of the present invention provides that a command to stop the winding station be emitted at any point in time at which the comparison result of the time periods per revolution of the friction roller and bobbin is at least approximately steady and at the same time deviates from the last-determined applicable theoretical value by a greater than tolerable amount, i.e. the comparison result falls outside the tolerable range. For example, if a drum winding occurs, the time period per revolution of the bobbin will be rapidly reduced because the bobbin is then no longer driven by the circumferential periphery of the friction roller but rather by the greater circumference of the drum windings of the yarn or strand formed about the friction roller. Since the method of the present invention will recognize this occurrence, the conventional provision of a special scanning device for detecting drum windings can be eliminated. As another example, if traversing of the traveling strand or yarn stops, whereby the strand is continuously wound onto the bobbin at the same location, the time period per revolution of the bobbin rises and likewise causes the comparison result to deviate outside the tolerabe range of the applicable theoretical value so that stoppage of the winding station is actuated under the present method. Thus, the present method further enables the elimination of a specialized traverse monitoring device at the winding station.

The present invention also provides for actuation of a bobbin brake at points in time during the winding operation at which the comparison results of the time periods per revolution of the friction roller and the bobbin is at least approximately steady and at the same time coincides at least approximately with selected theoretical values which may be determined, for example, empirically during a test run or by computation for bobbin diameters at which a non-uniform or inconsistent yarn build-up becomes noticeable or can be expected. Thus, the periodic application of the bobbin brake as necessary enables a more consistent and uniform strand build-up on the bobbin to be achieved.

According to the present invention, a predetermined relationship is established between the comparison result of the time periods per revolution of the winding bobbin and friction roller and the cumulative number of revolutions of the friction roller for the course of the winding operation. During the winding operation, the cumulative number of revolutions of the friction roller is continuously measured and, at any point in time at which the comparison result of the revolution time periods is at least approximately steady and at the same time the predetermined relationship between such comparison result and the measured number of friction roller revolutions is no longer met, a command is emitted for stopping the winding station, or a control signal is emitted to actuate a yarn brake to generate increased yarn tension, or a status signal is emitted to indicate an abnormal winding density or other abnormal condition.

The foregoing measures assure a continuous monitoring of the winding operation as well as a control or regulation of the strand winding density, without requiring special sensors or other monitoring devices.

According to a further feature of the present invention, at a time at which the time period per revolution of the friction roller is at least approximately steady and the comparison result of the revolution time periods of the friction roller and the bobbin is approximately steady, the drive for the friction roller is alternately supplied with reduced drive energy or is alternately switched to a neutral setting until after passage of a predetermined time period, passage of a predetermined number of revolutions of the friction roller, a predetermined maximum time period per revolution of the friction roller is reached, a time period per revolution of the friction roller is reached exceeding a minimum time period per revolution by a predetermined amount, a random amount within a predetermined range or a percentage amount, or a time period per revolution of the bobbin is reached above a selected value. The reduced drive energy supply or the neutral drive setting is continuously alternated with intervening periods during which the friction roller drive is supplied with increased drive energy, each such intervening period continuing until a predetermined minimum time period per revolution of the friction roller is reached.

For example, the drive for the friction roller may be continuously alternated between a state of energization or a supply of increased drive energy actuated when a predetermined maximum time period per revolution of the friction roller is reached and a state of de-energization or a supply of decreased drive energy when a predetermined minimum time period per revolution of the friction roller is reached. The minimum and maximum revolution time periods of the friction roller in this case are established as theoretical values which may be set as constant values.

For the initial start-up of the friction roller from a standstill, the present invention provides for the acceleration of the friction roller in several stages of increasing speeds, rather than as a continuous acceleration. According to this aspect of the present invention, each transition of the friction roller from one speed stage to the next-following speed stage is actuated at a time at which either the time period per revolution of the winding bobbin or the comparison result of the revolution time periods of the friction roller and the winding bobbin are at least approximately steady or have reached a set value. In this manner, the bobbin is accelerated rapidly but in a fashion that avoids the occurrence of undesirably significant slippage between the bobbin and the friction roller. Thus, the friction roller remains in each speed stage until the bobbin is driven with almost no slippage with respect to the friction roller and, then, the friction roller is shifted into the next-following stage of higher speed.

In the event of a breakage in the traveling strand, the last-determined theoretical value or actual value suitable for determining a theoretical value is utilized for controlling the return speed of the bobbin during correction of the strand brake, e.g., while locating the upstream broken strand end. Preferably, the bobbin return rotation is actuated by means of a specialized return drive device for the bobbin or by operation of the friction roller in reverse. By controlling the return speed of the bobbin, any unnecessarily high degree of slippage between the bobbin and a specialized return drive is avoided.

The present invention also provides suitable apparatus for monitoring and controlling the winding operation of a winding station in a textile winding machine for carrying out the method of the present invention. Such apparatus comprises a device associated with the bobbin for measuring a value proportional to its time period per revolution and a corresponding device associated with the friction roller for measuring a value proportional to its time period per revolution. Each such device is connected operably to an electronic calculator which includes a comparator for comparing the measured values of the bobbin and friction roller. The calculator is provided with suitable devices for establishing the aforesaid theoretical values for the result of the comparison of the measured values and the calculator is operatively connected with the drive means of the friction roller, and optionally also with a winding station stopping device and a signaling device, for selectively controlling regulation of the friction roller drive, stopping of the winding station, or signaling for intervention in the winding operation, as a function of deviations in the comparison result determined by the comparator from the theoretical values determined by the calculator. Any suitable electronic calculator, computer, microprocessor or the like may be utilized.

The present invention is particularly suited for application in textile winding machines wherein each of the bobbin and the friction roller are respectively provided with a pulse generator adapted to emit one pulse per revolution. Each pulse generator is operatively connected to an electronic calculator which comprises a frequency generator, a first time period counter opertively associated with the frequency generator and the pulse generator of the bobbin for measuring a frequency value proportional to the time period per revolution of the bobbin and a second time period counter operatively associated with the frequency generator and the pulse generator of the friction roller for measuring a frequency value proportional to the time period per revolution of the friction roller. The calculator further includes a comparator for comparing the measured frequency values of the first and second counters and suitable devices for establishing theoretical values for the result of comparison of the measured frequency values. As aforementioned, the calculator is operatively associated with the friction roller drive for selectively controlling regulation of the drive, intervention in the winding operation or stopping of the winding station as a function of deviations in the comparison result from the theoretical values.

Each time period counter is adapted to count the number of oscillation periods generated by the frequency generator during each revolution of the respectively associated bobbin or friction roller. The result is then transmited by each counter to the comparator, which preferably comprises either an adder, subtractor, multiplier or divider to determine the comparison result of the respective measured values as a sum, difference, product or quotient thereof, preferably a quotient. The comparison result is then compared to the theoretical values established by the appropriate devices of the calculator, which may consist of a computing circuit of the calculator adapted to continuously determine new theoretical values.

According to a further aspect of the apparatus of the present invention, the drive means for the friction roller includes a controllable drive motor operatively connected via a motor control device to the electornic calculator. The motor control device may for simplicity be a contractor, a star-delta switch or a similar control component or device. Advantageously, the drive motor may be a frequency-controlled or a phase-angle-controlled asynchronous motor, with the motor control device being a frequency converter or phase-angle control, either of which provide a particularly sensitive means of drive control. An asynchronous motor provides an especially robust and economical drive element.

The present apparatus further provides a pair of rotatable bobbin tube carrier elements for supporting the central tube or core of the bobbin at each of its ends, with at least one of the carrier elements being connected to a controllable brake device which is in turn operatively connected to the electronic calculator.

The brake device is adapted to be actuated in accordance with the comparison result of the revoluton time periods of the friction roller and bobbin as determined by the comparator when the calculator acts to stop operation of the winding station or when the comparison result is at least approximately steady and at the same time coincides at least approximately with a selected theoretical value. The braking of the bobbin in the former circumstance during a stopping procedure serves to rapidly bring the bobbin to a standstill so that, as necessary, bobbin replacement or other required operations can be completed more rapidly. In the latter circumstance, the braking of the bobbin at predetermined comparison result values serves to produce a more uniform and consistent build-up of the bobbin.

The winding station may preferably include a suitable device operatively connected to the calculator for stopping operation of the winding station automatically when the comparison result of the revolution time periods of the bobbin and friction roller is at least approximately steady and has also reached a predetermined final value or has deviated from an applicable theoretical value by a greater than tolerable amount. In the first case when the comparison result has reached its predetermined final value, the desired bobbin diameter has been reached. In the latter case, the deviation of the comparative result from the theoretical value indicates a breakdown or disturbance in the winding operation, for example, the formation of a drum winding or a traversing malfunction or problem. In each instance, the operation of the winding station is stopped so that a new bobbin may be installed or the problem may be corrected, as the case may be.

The calculator may also include a counter for counting the cumulative number of revolutions of the friction roller and a companion device for establishing a theoretical value relationship, applicable for the entire bobbin winding operation, between the comparison result of the revolution time periods of the friction roller and bobbin and the number of revolutions of the fricton roller, the relationship being established with consideration for applicable parameters for the particular winding process including at least the yarn type, yarn strength and desired winding density. When the comparison result is at least approximately steady and at the same time the predetermined relationship between the comparison result and the measured number of friction roller revolutions ceases to be met, the calculator is adapted to actuate the stopping device or a signaling device or a controllable yarn tensioning device. Deviation from the predetermined relationship indicates a deviation from the desired winding density which requires correction. Control of the tension in the traveling strand being wound may be effective to adjust the actual winding density into conformity with the desired theoretical density.

According to another feature of the present apparatus, the winding station is provided with a control device for regularing the return speed of the bobbin when reversed for purposes of locating an upstream broken strand end following a strand breakage. This control device is regulated in accordance with the last-applicable theoretical value or the last actual value of the comparison result suitable for formulation of an applicable theoretical value. Such comparison result provides an indication as to the bobbin size, diameter or weight so that the return speed of the bobbin may be adjusted accordingly during reversal for locating the upstream broken end. The control device may be identical to the control device for the friction roller or may be combined with it.

BRIEF DESCRIPTION OF THE DRAWINGS

FIG. 2 is a diagram comparatively illustrating the time periods per revolution of the friction roller and the bobbin over the course of a winding operation during which the friction roller is operated at a constant speed;

FIG. 4 is a diagram comparatively illustrating the time periods per revolution of the bobbin and the friction roller over a short period of the bobbin winding operation during which the time period per revolution of the friction roller is constantly varied according to one embodiment of the present invention;

FIG. 5 is another diagram similar to FIG. 4 comparatively illustrating the time periods per revolution of the bobbin and the friction roller over a comparably short period of the bobbin winding operation during which the time period per revolution of the friction roller is constantly varied according to another embodiment of the present invention; and FIG. 6 is a diagram comparatively illustrating the time periods per revolution of the friction roller and the bobbin during acceleration thereof from a standstill to their full operating speeds.

DESCRIPTION OF THE PREFERRED EMBODIMENT

Figure 1:
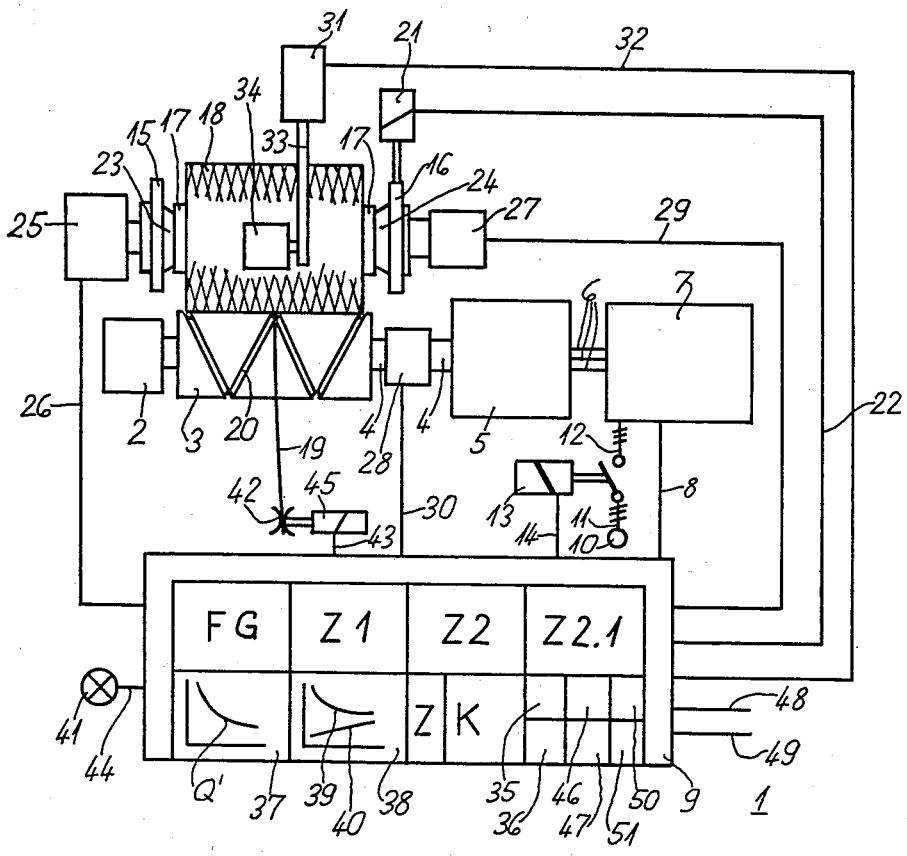
FIG. 1 is a schematic view of a winding station in a textile winding machine incorporating the preferred embodiment of the method and apparatus of the present invention.

Referring now to the accompanying drawings and initially to FIG. 1, a winding station, or "winding head" of an automatic textile bobbin winder is representatively shown generally at 1. As those persons skilled in the art will recognize, all of the details of the winding station are not shown for sake of simplicity. The winding station 1 includes a friction roller 3 which is rotatabloy supported stationarily at one axial end by a bearing 2 and at the opposite axial end by connection to the shaft 4 of a three-phase asynchronous motor 5 which operates as the drive means for the friction roller 3. The three-phase asynchronous motor 5 is operatively connected by leads 6 to a control device 7 preferably in the from of a frequency converter, although alternatively a phase-angle control may be utilized as the motor control device 7. The frequency converter 7 is operatively connected by a control lead 8 to electronic calculator 9. The frequency converter 7 is supplied with operating voltage from a conventional voltage source 10 through multicore leads 11,12 between which a contactor 13 is situated for selectively connecting and disconnecting the leads 11,12. The contactor 13 thus is adapted to serve as a suitable means for stopping operation of the winding station 1 when necessary. The contactor 13 is further connected operatively through a control lead 14 to the electronic calculator 9 for controlling operation of the contactor 13.

The winding station 1 also includes support elements 15,16 arranged in spaced relation to form a pivotably mounted creel for rotatably carrying a tube 17 for cross-winding thereon of yarn or strand to form a bobbin as shown at 18. The peripheral circumference of the bobbin 18 rests with a certain contact force on the peripheral circumference of the friction roller 3 to be peripherally driven rotatably thereby during the winding process. The bobbin 18 is supplied with a yarn, thread or like strand 19 for winding thereabout, the friction roller 3 being provided with reverse grooves 20 in which the strand 19 is guided to cause the strand 19 to be continuously traversed back and forth along the axial length of the bobbin 18 to apply the strand 19 thereto in a cross-wound fashion over the course of the winding operation.

The creel elements 15,16 are adapted to be opened and closed with respect to one another in order to permit removal of a fully wound bobbin 18 and insertion of a new empty bobbin tube 17 at the completion of a winding operation. Additionally, the creel elements 15,16 are operatively connected to an electromagnetic lifting device 21 which may be operated to separate the winding bobbin 18 from peripheral contact with the friction roller 3, thereby to function as another stopping means for the winding station 1. The lifting device 21 is operatively connected by a control lead 22 to the electronic calculator 9 for control of operation of the lifting device 21.

The creel elements 15,16, respectively include rotatable tube carrier elements 23,24 which are of a conical configuration tapering toward one another in the direction of the bobbin tube 17 so as to be adapted for receiving and supporting tubes of differing diameters. A controllable brake device 25 is operatively connected to the rotatable tube carrier element 23 and, in turn, is operatively connected by a control lead 26 to the electronic calculator 9. A pulse generator 27 is connected to the other rotatable tube carrier element 24 and is operable to transmit a pulse to the electronic calculator 9 through a pulse lead 29 at each revolution of the tube carrier element 24 and thereby also at each revolution of the tube 17 and bobbin 18.

Another pulse generator 28 is likewise provided on the shaft 4 of the friction roller 3 to operate to transmit a pulse through a pulse lead 30 to the electronic calculator 9 at each revolution of the shaft 4 and thereby also at each revolution of the friction roller 3.

The winding station 1 also includes a control device 31 adapted for regulating the return speed of the bobbin 18 in reverse as necessary to locate an upstream broken yarn end on the bobbin 18 during piecing operations to correct a strand break. The control device 31 is operatively connected to the electronic calculator 9 through a control lead 32. The control device 31 includes a pivotable arm 33 having a drive roller 34 mounted at the end thereof for variable speed rotation. Upon the occurrence of a strand brake, the bobbin 18 is separated from contact with the friction roller 3 by means of the lifting device 31 and is driven in reverse by the drive roller 34 in order to locate the upstream broken yarn end wound onto the bobbin 18. In this manner, the control device 31 enables the reverse drive speed of the bobbin 18 to be controlled according to the bobbin diameter, as hereinafter more fully explained.

The electronic calculator 9 includes a frequency generator FG and time period counters Z1,Z2, each of which is associated with a respective one of the bobbin 18 and the friction roller 3 and is further operatively connected to the frequency generator FG. The counters Z1,Z2 are controlled by the pulse generators 27, 28 associated with the bobbin 18 and the friction roller 3 in order to determine the time period per revolution of each thereof, as more fully explained hereinafter. The calculator 9 also includes a comparator K operatively connected to the counters Z1,Z2 for comparing their respective counting results.

The calculator 9 is further provided with suitable devices 37,38 adapted for setting or establishing theoretical values and companion devices 35,36 adapted for adjusting or varying such theoretical values. As aforementioned, the calculator is operatively connected with the drive motor 5 of the friction roller 3 through leads 6,8 and frequency converter 7. Similarly, the calculator 9 is operatively connected with the contactor 13 through operative lead 14 and with the lifting device 21 through operative lead 22 to control such devices as stopping means for the winding station 1.

According to the present invention, the calculator 9 controls the operative speed of the drive motor 5 of the friction roller 3 by control of the frequency converter 7 through control lead 8 and further controls the de-actuation or stopping of the overall winding station 1 by control of the contactor 13 and lifting device 21 through the respective control leads 14,22, all in accordance with the result of the comparison by comparator K of the time periods per revolution of the friction roller 3 and the bobbin 18, as reflected by the number of oscillations or periods of the frequency generator FG per revolution of each of the friction roller 3 and bobbin 18. Thus, when the winding station 1 is stopped, the bobbin 18 is separated from contact with the friction roller 3 by actuation of the lifting device 21 and simultaneously the contactor 13 is operated to disconnect the leads 11 and 12 to stop voltage supply to the drive motor 5 of the friction roller 3. Alternatively, the frequency converter 7 can be de-actuated through the control lead 8 to likewise cut off voltage supply to the motor 8. Upon any such stoppage of the winding station 1, the bobbin 18 may also be braked by actuation of the braking device 25 through its control lead 26 to bring the bobbin 18 rapidly to a standstill.

Various reasons exist for stopping the rotation of the winding bobbin 18 and overall operation of the winding station 1 as quickly as possible when necessary during the course of a bobbin winding operation. In an automatic bobbin winder utilized for re-winding yarn or strand from spinning cops onto a larger bobbin such as bobbin 18, the winding station must be stopped each time the supply yarn from a spinning cop is exhausted and the re-started after the trailing yarn end of the exhausted cop has been connected to a new cop. Further, in the case of yarn breaks and the detection of other yarn defects, the winding station 1 must also be stopped for correction of the break or defect and then re-starting of the winding station. This procedure of stopping and re-starting the winding station 1 can often occur approximately 50 times over the course of the winding of a single bobbin and, accordingly, it is particularly important to stop the winding station and re-start it as rapidly as possible. As will be understood, the present invention assists in addressing this problem.

The calculator 9 additionally includes a counter Z2.1 adapted for counting the cumulative number of revolutions completed by the friction roller 1 over the course of a winding operation. The aforesaid theoretical value setting device 38 establishes a relationship, applicable for the entire course of a bobbin winding operation, between the result of the comparison of the time periods per revolution of the friction roller 3 and the winding bobbin 18, preferably formed as a quotient, and the number of cumulative revolutions of the friction roller 3. In the establishment of this relationship, consideration is made for various applicable parameters of the particular winding operation involved, including at least the particular yarn type, strength and winding density. In the schematic depiction of the theoretical value setting device 38 in FIG. 1, the relationship established by the theoretical value setting device 38 is shown as a diagram in the form of a coordinate graph wherein the elapsed winding time over the course of a winding operation is plotted on the abscissa. The comparison result of the time periods per revolution of the friction roller 3 and the bobbin 18 is represented by the curved line 39, while the cumulative number of revolutions of the friction roller 3 is represented by the line 40. The calculator 9 is adatped for actuation of the stopping devices 13,21, and/or a status signaling device 41, and/or a controllable yarn tensioning device 42, at any point in time at which the comparison result of the time periods per revolution of the friction roller 3 and bobbin 18 is at least approximately steady and simultaneously the set relationship between the comparison result 39 and the measured number of revolutions 40 of the friction roller 3 ceases to be met.

As seen in FIG. 1, the controllable yarn tensioning device 42 is driven by an electromagnetic drive 45 controlled through a lead 43 operatively connected to the electronic calculator 9. Accordingly, as so embodied, the winding station 1 need not be stopped and no signaling device need be actuated when the predetermined relationship between the comparison result 39 and cumulative revolutions 40 is not met. Instead, by control of the tension in the traveling yarn through the yarn tensioning device 42, the desired or required winding density of the bobbin 18 may correspondingly be adjusted to in turn affect the comparison result 39. On the other hand, if the winding station 1 were not equipped with the yarn tensioning device 42 or the comparison result 39 could not otherwise be affected, the signaling device 41 is activated through its control lead 44 to notify a machine attendant of a deviation in the winding density of the bobbin 18 from the established norm. If necessary, the winding station 1 may also be stopped at this time through actuation of the contactor 13 and lifting device 21.

FIG. 2 diagrammatically illustrates the progression of the time periods F per revolution of the friction roller 3 and the time period A per revolution of the bobbin 18 in a coordinate graph system wherein the elapsed winding time t forms the abscissa and the time period per revolution t/u forms the ordinate. For sake of simplicity in this illustration, the diagram of FIG. 2, however, does not depict the continuous variation of the time period per revolution of the friction roller 3 over the course of the winding operation, as contemplated by the present invention and as hereinafter described, nor is any illustration made to reflect periodic stoppages of the bobbin winding operation, as of course would normally occur. As illustrated, the start-up of the bobbin winding operation begins at time t0, whereat the rotation of the friction roller 3 begins with the empty bobbin tube 17 resting in peripheral contact on the friction roller 3. Since at this time the traveling strand or yarn has not yet begun to be wound about the empty tube 17, the bobbin 18 has not yet been formed. As the winding operation progresses with the strand or yarn being traversingly applied to the tube 17, the windings of the strand progressively build the bobbin 18. By the time t1, the bobbin 18 has reached a diameter equal to that of the friction roller 3 as a result of the strand build-up on the tube 17. By time t2, the diameter of the bobbin 18 is 1 ½ times as large as the diameter of the friction roller 3. As will thus be understood, up to the time t1 the time period A of each revolution of the bobbin 18 is less than the constant time period F of each revolution of the friction roller 3. However, after time t1, the time period A per revolution of the bobbin 18 is greater than the revolution time period F of the friction roller 3.

In practice, the start-up of the winding operation of the winding station 1 from a standstill after a stoppage of the winding operation is carried out in stages as illustrated in FIG. 6 which diagrammatically depicts the time periods F per revolution of the friction roller and the time periods A per revolution of the bobbin over the course of a start-up of the winding operation in a coordinate graph system wherein the elapsed winding time t forms the abscissa and the time period per revolution t/u forms the ordinate.

In the initial stage of start-up, the lifting device 21, the brake device 25 and the control device 31 are out of operation, while the contactor 13 is actuated to complete voltage supply to the frequency converter 7 which is controlled by the calculator 9 to reach a speed approximately one-third of the full normal operating speed by the time t0.1. At this time, the frequency generator FG, the time periods counters Z1,Z2 and the comparator K are in operation. The timer period counter Z1 operates to count the number of oscillation periods carried out by the frequency generator FG during each revolution of the tube carrier element 24, the pulses transmitted by the pulse generator 27 being utilized to signal the beginning and ending of each revolution. The counting result of the counter Z1 is transmitted for each revolution to the comparator K, whereupon the counter Z1 re-sets itself to a zero setting and repeats the counting operation for the next succeeding revolution. The time period counter Z2 performs the identical operation in association with the pulse generator 28 for monitoring the time period for each revolution of the friction roller 3.

In the preferred embodiment, the comparator K continuously forms a quotient from the inputs of the revolution time periods for the friction roller 3 and bobbin 18 as received from the counters Z1,Z2, such quotient then serving as the aforesaid comparison result.

As will be understood, during the start-up acceleration of the friction roller 3 in the initial stage of start-up, slippage occurs between the friction roller 3 and the bobbin 18, which gradually reduces as the friction roller 3 approaches time t0.1 and the one-third operating speed. As soon as the comparator K has determined at time t0.1 that the resulting comparison quotient of the revolution time periods F,A of the friction roller 3 and the winding bobbin 18 is at least approximately steady, indicating that slippage between the friction roller 3 and the bobbin 18 has reached a minimum value, the electronic calculator 9 actuates transition into the next-following start-up stage by causing the frequency converter 7 through the control lead 8 to accelerate the drive motor 5 and its friction roller 3 up to a speed approximately two-thirds of the full normal operating speed of the friction roller 3. Hereagain, acceleration of the fricton roller 3 through the second start-up stage produces slippage between the bobbin 18 and the friction roller 3, but again the slippage reaches a minimum value by time t0.2, as will be recognized by comparator K as approximately constancy of the comparison result of the revolution time periods of the friction roller 3 and the bobbin 18. Thereupon, transition into the next-following start-up stage is similarly actuated by operation of the electronic calculator 9 to cause the frequency converter 7 to accelerate the drive motor 5 and the friction roller 3 up to full operating speed. Slippage again occurs between the bobbin 18 and the friction roller 3 until time t0.3 at which the revolution time periods of the friction roller 3 and the bobbin 18 are again approximately steady.

At time t0.3, the start-up of the friction roller 3 and, in turn, of the winding operation, is completed. At this time according to the practical operation of the present invention, the electronic calculator 9 operates to begin continuous variation of the time period per revolution of the friction roller 3, the variation being adjustable by a theoretical value setting device 46 as illustrated in FIG. 4 or alternatively adjustable by a theoretical value setting device 47 as illustrated in FIG. 5.

With reference first to FIG. 4, the diagram thereof depicts a relatively short time period during the course of the bobbbin winding operation following the time t1 of FIG. 2. In FIG. 4, the measured time period F per revolution of the friction roller 3 and the measured time period A per revolution of the bobbin 18 over the course of such short periods of time are plotted in a coordinate graph similar to FIG. 2 and 6 wherein winding time t forms the abscissa and the time periods per revolution t/u forms the ordinate. As previously described, prior to the time T1 the friction roller 3 was accelerated until it reached its normal operating speed, with the bobbin 18 following this acceleration with slippage. At the time t1, the comparator K determines the approximately constancy of the continuously formed quotient of the revolution time periods F,A, indicating that the bobbin 18 is then driven by the friction roller 3 essentially free of slippage. At this time, the justdetermined quotient Q' is stored in the theoretical value device 37 until the next occurrence of synchronysm of the bobbin 18 and the friction roller 3. The graphical diagram shown in FIG. 1 in the theoretical value setting device 37 representatively illustrates the succession of quotients Q' determined and stored in the device 37 over the course of a complete winding operation as plotted in a coordinate graph system wherein the elapsed winding time forms the abscissa and the quotient Q' forms the ordinate.

Each stored quotient Q' is utilized as a theoretical quotient value against which quotients subsequently determined by the comparator K are compared. Following storage of a quotient Q', if a quotient subsequently determined by the comparator K deviates from the stored throretical quotient Q', the electronic calculator 9 operates to then intervene into the winding process and, depending upon the magnitude of the deviation, either to stop operation of the winding station by de-actuating the friction roller 3 through operation of the contactor 13 or alternatively through control of the frequency converter 7 and simultaneous actuation of the lifting device 21 (optionally also by activating the brake device 25) or to modify the control of the frequency convertor 7 to in turn influence the drive motor 5 to regulate the speed of the friction roller 3 to conform the actual quotient then determined by the comparator K to the stored theoretical quotient Q'.

In FIG. 4, as determined by the theoretical value setting device 46, the calculator 9 operates to de-activate the drive motor 5 at the time T1, which may be accomplished either by operating the contactor 13 to break operative connection of the leads 11 and 12 or to appropriate control the frequency convertor 7 to stop the drive motor 5. As will be understood, the time period F per revolution of the friction roller 3 then increases, as does the time period A per revolution of the bobbin 18, until a pre-determined revolution time period F' of the roller 3 or a pre-determined maximum revolution time period A' of the bobbin 18 is reached. Until such time the bobbin 18 runs almost free of slippage with respect to the friction roller 3. The time T1.1 represents the point in time at which the predetermined maximum revolution time F' or A' has been reached, by which time the rotational speeds of the friction roller 3 and the bobbin 18 have decreased, for example, by ten percent. Thereupon, the drive motor 5 is re-actuated to re-accelerate to its rated normal full operating speed in a relatively short period of time, whereupon the revolution time periods F,A again become approximately steady. As previoualy explained, during such acceleration of the drive motor 5, the bobbin 18 follows the acceleration of the friction roller 3 with slippage but such slippage is gradually eliminated as the full operating speed of the friction roller 3 and the bobbin 18 is approached, which can be recognized from the approximate steadiness of the quotient of the revolution time periods F,A determined in the comparator K. This point in time at which the comparison quotient again reaches an approximately steady value is represented in FIG. 4 at time T2. Thereupon, the just-determined comparison quotient is stored as a new theoretical quotient value Q' in the theoretical value setting device 37. At this point, the described sequence is repeated by again deactuating the drive motor 5 until a predetermined maximum time period per revolution F' or A' is reached, whereupon the drive motor 5 is re-actuated for acceleration to normal full operating speed, and so forth, the sequence being repeated until the conclusion of the winding operation. From time to time, the quotient determined in this procedure will vary somewhat, but in the normal case there changes are only very slight. If greater changes should occur, invention into the winding operation is immediately actuated, either to stop the operation altogether or to modify the friction roller drive to adjust the actual quotient, as aforementioned.

The electronic calculator 9 may also be provided with a random number generator Z by which the percentage increase of the revolution time period F' or A' over the minimum revolution time period A or F at full operating speed of the friction roller 3 may be re-set randomly from time to time within a tolerable range. For this purpose, the random number generator Z operates to supply random numbers within the tolerable range to randomly change the applicable maximum revolution time period F' or A' within the tolerable range, thereby to achieve a particularly uniform strand build-up of the bobbin 18.

FIG. 5 depicts an alternative manner of continuously varying the time period per revolution of the friction roller 3 as set at the theoretical value setting device 47. As in FIG. 4, the diagram of FIG. 5 representatively plots the revolution time periods A,F over a relatively short period of the winding operation in a coordinate graph wherein the elapsed winding time t forms the abscissa and the time period per revolution t/u forms the ordinate. Minimum and maximum values F'', F''' are permanently set by the theoretical value adjusting device 35 to represent the minimum and maximum time periods per revolution of the friction roller 3 which are desired. Each time the friction roller 3 reaches its minimum time period per revolution F'', the calculator 9 operates to de-actuate the drive of the friction roller 3, following which the friction roller 3 operates in a neutral or idling state until its time period per revolution increases to the maximum predetermined revolution time F'''. Thereupon, the drive of the friction roller 3 is again actuated to accelerate the friction roller 3 with a relatively large drive moment so that the friction roller 3 reaches its predetermined minimum revolution time F'' as quickly as possible. This sequence is repeated over the course of the winding operation, as depicted in FIG. 5.

As will be understood, the bobbin 18 follows with slippage the changing accelerations and decelerations to which the friction roller 3 is subjected. Thus, as seen in FIG. 5, at the time T4, the minimum revolution time period F'' of the roller 3 is reached and the deactuation of the drive of the roller 3 then begins. As the friction roller 3 then decelerates, the bobbin 18 slips with respect thereto so that the quotient of their respective revolution time periods is not steady immediately following the timer T4. However, by the time T5, slippage of the bobbin 18 has been essentially eliminated and the quotient of the revolution time periods of the friction roller 3 and the bobbin 18 is then substantially steady and could be utilized as the theoretical quotient value Q. However, the maximum revolution time period F''' of the friction roller 3 has not yet been reached at time T5 and is not reached until time T6. At that time, the comparison quotient of the revolution time periods of the friction roller 3 are still essentially constant and the then-prevailing comparison quotient is transmitted to the theoretical value setting device 37 for storage as the theoretical quotient value Q. At the same time, the drive motor 5 is re-actuated to rapidly accelerate the friction roller 3 until it reaches a speed at which the time period per revolution coincides with the minimum revolution time F'', whereupon the drive motor 5 is again de-actuated. The bobbin 18 follows such acceleration of the friction roller 3 with slippage and, furthermore, even after the friction roller drive motor 5 is subsequently de-actuated to begin decelerating, slippage is still occurring between the bobbin 18 and the friction roller 3 and is not again eliminated until the time T7 is reached. The bobbin 18 remains essentially free from slippage with respect to the friction roller 3 until the time T8, at which the theoretical value quotient Q is re-determined and again stored in the theoretical value transmitter 37. Following the time T8, slippage of the bobbin 18 occurs during the following acceleration and deceleration of the friction roller 3 until the time T9, with the theoretical quotient Q again being determined and stored at subsequent time T10. This sequence of operation continues until the completion of the bobbin winding operation.

A control lead 48 into the electronic calculator 9 may be provided to enable a stop pulse or signal to be transmitted to the calculator 9 to actuate stoppage of the winding station operation. Such a stop pulse may be furnished by a yarn monitoring device (not shown) adapted to scan the traveling strand 19 to detect the presence of yarn defects or errors and, in turn, can be adapted to transmit a stop pulse to the calculator 9 when a defect or error is sensed which requires stoppage of the winding station 1.

It is also known to correct a breakage or other interruption in the traveling strand supply by automatic equipment, such as an automatic splicing or knotting device. Accordingly, the calculator 9 may also be provided with another input control lead 49 by which a start pulse may be transmitted to the calculator 9, for example by such an automatic splicing or knotting device, to actuate a re-start of the winding operation following completion of the device's automatic operation.

The present invention also provides several possible manners of actuating stoppage of the operation of the winding station 1 when the bobbin 18 has been fully wound.

Since the counter Z2.1 is operative to count the cumulative number of revolutions of the friction roller 3 over the course of the winding operation, this offers one such possibility. The number of revolutions of friction roller 3 may be related a least roughly to the length of the strand wound onto the bobbin 18 and, thus, a predetermined number of friction roller revolutions necessary to fully wind a total desired strand length onto the bobbin 18 may be established and pre-set by means of another theoretical value setting device 50. Once the counter Z2.1 has counted the cumulative number of friction roller revolutions predetermined at the theoretical value setting device 50, the electronic calculator 9 operates to stop operation of the winding station 1 by de-actuating the drive motor 5, actuating the lifting device 21 and, optionally, actuating the brake device 25.

Figure 3:
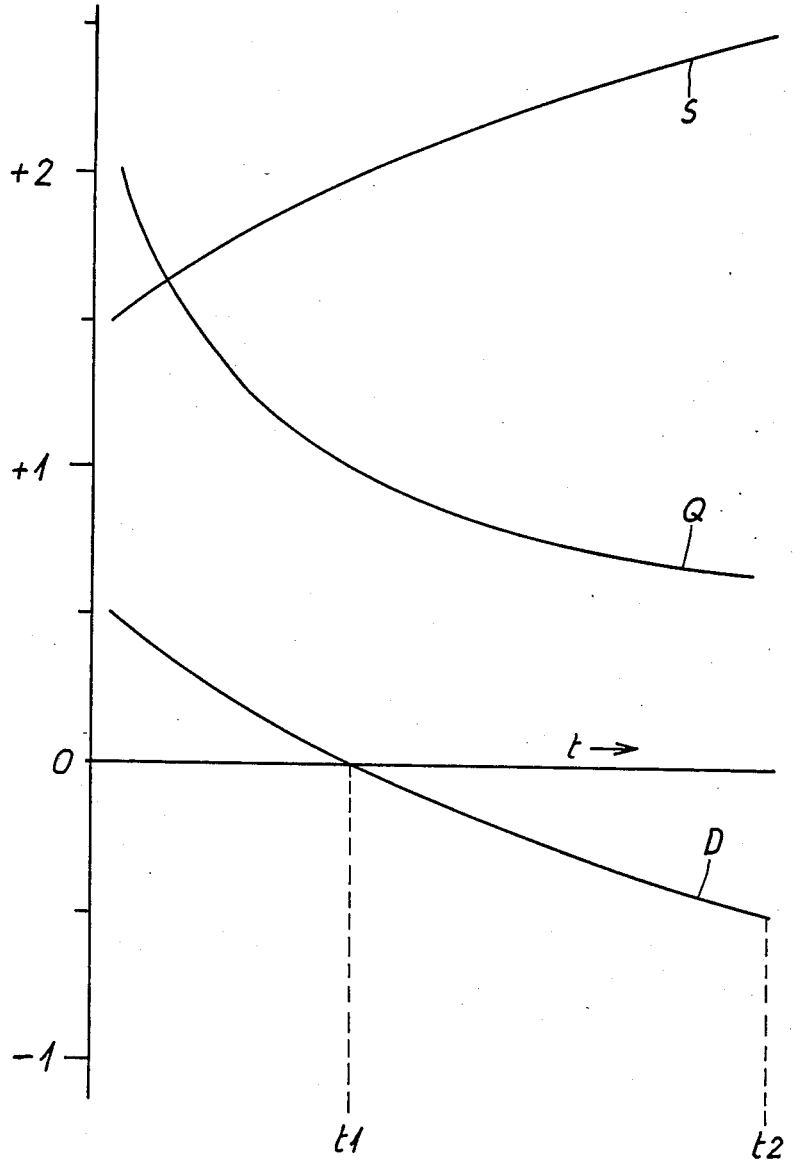
FIG. 3 is a diagram illustrating the sums, quotients and differences of the time periods per revolution of the friction roller and the bobbin over the course of the bobbin winding operation of FIG. 2.

On the other hand, the course of the comparison result of the time periods per revolution of the friction roller 3 and the bobbin 18 determined through the comparator K also provides a direct indication of the bobbin diameter. In FIG. 3, the comparison result determined by the comparator K over the course of a winding operation is illustrated as a sum S of a quotient Q and a difference D of the revolution time periods plotted in a coordinate system wherein the elapsed winding time T of the winding operation forms the abscissa and the computed value of the comparison result forms the ordinate. Once the comparison result has reached a certain value, the bobbin 18 will have reached a certain diameter at the same time. Accordingly, the calculator 9 can be adapted to stop operation of the winding station 1 as soon as the actual comparison quotient determined by the comparator K coincides with a predetermined theoretical quotient set in the theoretical value setting device 37 corresponding to a desired maximum bobbin diameter.

As a third alternative, the electronic calculator 9 may be adapted to stop operation of the winding station 1 when the comparson result of the revolution time periods of the bobbin 18 and friction roller 3 is at least approximately steady and at the same time the predetermined relationship between the comparison result and the cumulative number of friction roller revolutions as set in the theoretical value setting device 38 has reached a predetermined value. At such time, the bobbin 18 will have reached a corresponding bobbin fullness.

The present invention also contemplates that several theoretical quotients may be permanently set in another theoretical value setting device 51 so that the bobbin brake 25 may be temporarily actuated for either sustained or intermittent braking action at times at which the comparison quotient of the revolution time periods of the bobbin and friction roller is at least approximately steady and at the same time coincides at least approximately with the theoretical quotient values set in the device 51. In this manner, a more consistent and uniform strand build-up on the bobbin 18 may be achieved.

It will therefore be readily understood by those persons skilled in the art that the present invention is susceptible of a broad utility and application. Many embodiments and adaptions of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A method of monitoring and controlling winding operation of a winding station in a textile winding machine of the type wherein a bobbin is rotatably driven by a driven friction roller in peripheral contact with said bobbin for winding a traveling strand about said bobbin, said method characterized by the steps of essentially constantly varying the time period per revolution of said friction roller while constantly measuring the time period per revolution of each of said friction roller and said bobbin and at least intermittently comparing the time periods per revolution of said friction roller and said bobbin, establishing theoretical values for the result of comparison of the time periods per revolution of said friction roller and said bobbin over the course of a winding operation, and selectively controlling regulation of the drive of said friction roller, intervention of said winding operation, and stopping of said winding station as a function of deviations in said comparison result from said theoretical values.

2. A method of monitoring and controlling winding operation of a winding station in a textile winding machine according to claim 1 and characterized further in that said comparing includes forming a quotient from the time periods per revolution of said friction roller and said bobbin.

3. A method of monitoring and controlling winding operation of a winding station in a textile winding machine according to claim 1 and characterized further in that said comparing is performed at times at which said bobbin is driven generally without slippage with respect to said friction roller.

4. A method of monitoring and controlling winding operation of a winding station in a textile winding machine according to claim 1 and characterized further in that said varying the time period per revolution of said friction roller includes one of alternately supplying said drive means for said friction roller with increased and decreased drive energy and periodically supplying drive energy to said drive means, and establishing said comparison result obtained during a time period during which said comparison result remains at least approximately steady as one said theoretical value for use during at least a following period of time.

5. A method of monitoring and controlling winding operation of a winding station in a textile winding machine according to claim 1 and characterized further by stopping the winding operation of said winding station and separating said bobbin from peripheral contact with said friction roller at a time at which said comparison result is at least approximately steady and has reached a predetermined final value.

6. A method of monitoring and controlling winding operation of a winding station in a textile winding machine according to claim 1 and characterized further by stopping the winding operation of said winding station at a time at which said comparison result is at least approximately steady and deviates from an applicable one of said theoretical values by a greater than tolerable value.

7. A method of monitoring and controlling winding operation of a winding station in a textile winding machine according to claim 1 and characterized further by braking said bobbin at times at which said comparison result is at least approximately steady and coincides at least approximately with an applicable one of said theoretical values.

8. A method of monitoring and controlling winding operation of a winding station in a textile winding machine according to claim 1 and characterized further by establishing a predetermined relationship of said comparison result and the number of revolutions of said friction roller, continuously counting the number of revolutions of said friction roller, and, at a time at which said comparison result is at least approximately steady and said predetermined relationship is not met, performing one of stopping the winding operation of said winding station, braking said traveling strand by generating strand tension, and signaling the existence of an abnormal winding condition.

9. A method of monitoring and controlling winding operation of a winding station in a textile winding machine according to claim 1 and characterized further in that said controlling said friction roller includes, at a time at which the time period per revolution of said friction roller is at least approximately steady and said comparison result is approximately steady, performing one of (a) alternately loading said drive means for said friction roller with reduced drive energy, and (b) alternately swtiching said drive means to a neutral setting, until after one of the following occurrences: (i) passage of a predetermined time period, (ii) the passage of a predetermined number of revolutions of said friction roller, (iii) a predetermined maximum time period per revolution of said friction roller is reached, (iv) a time period per revolution of said friction roller is reached exceeding a minimum time period per revolution by an amount selected as one of a predetermined amount, a random amount within a predetermined range and a percentage amount, and (v) a time period per revolution of said bobbin is reached above a selected value; and, intervening said alternate loading or alternate switching, loading said drive means with increased drive energy until a predetermined minimum time period per revolution of said friction roller is reached.

10. A method of monitoring and controlling winding operation of a winding station in a textile winding machine according to claim 1 and characterized further by, in continuous alternation, loading said drive means for said friction roller with increased drive energy when a predetermined maximum time period per revolution of said friction roller is reached and applying a decreased drive energy to said drive means when a predetermined minimum time period per revolution of said friction roller is reached.

11. A method of monitoring and controlling winding operation of a winding station in a textile winding machine according to claim 1 and characterized further by accelerating said friction roller from standstill to normal operating speed in a plurality of stages of increasing speeds, and initiating transition into each nextfollowing stage at a time at which one of the time period per revolution of said winding bobbin and said comparison result is approximately steady or has reached a predetermined value.

12. A method of monitoring and controlling winding operation of a winding station in a textile winding machine according to claim 1 and characterized fruther by controlling a return speed of said bobbin during correction of a strand break according to one of the last-applicable one of said theoretical values and an actual value of said comparison result from which a theoretical value may be formed.

13. Apparatus for monitoring and controlling winding operation of a winding station in a textile winding machine of the type wherein a bobbin is rotatably driven by a friction roller in peripheral contact with said bobbin for winding a traveling strand about said bobbin, said friction roller being driven by an associated drive means, characterized by means associated with said bobbin for measuring a value proportional to the time period per revolution of said bobbin, means associated with said friction roller for measuring a value proportional to the time period per revolution of said friction roller, an electronic calculator operatively connected with each said value measuring means, said calculator comprising a comparator for comparing the measured values of said bobbin and said friction roller and means or establishing theoretical values for the result of comparison of said measured values, said calculator being operatively associated with said drive means for selectively controlling regulation of said drive means of said friction roller, intervention in said winding operation, and stopping of said winding station as a function of deviations in said comparison result determined by said comparator from said theoretical values determined by said establishing means of said calculator.

14. Apparatus for monitoring and controlling winding operation of a winding station in a textile winding machine according to claim 13, and characterized further in that said calculator is operatively associated with stop means for said winding station for stopping the winding operation thereof.

15. Apparatus for monitoring and controlling winding operation of a winding station in a textile winding machine according to claim 13, and characterized further in that said calculator is operatively associated with a signaling device for transmitting a status signal with respect to winding operation of said winding station.

16. Apparatus for monitoring and controlling winding operation of a winding station in a textile winding machine of the type wherein a bobbin is rotatably driven by a friction roller in peripheral contact with said bobbin for winding a traveling strand about said bobbin, said friction roller being driven by an associated drive means, each of said bobbin and said friction roller having an associated pulse generator adapted to emit one pulse per revolution thereof, and wherein an electronic calculator is operatively connected to said pulse generators, characterized in tha said electronic calculator comprises a frequency generator, a first time period counter operatively associated with said frequency generator and said pulse generator of said bobbin for measuring a frequency value proportional to the time period per revolution of said bobbin, a second time period counter operatively associated with said frequency generator and said pulse generator of said friction roller for measuring a frequency value proportional to the time period per revolution of said friction roller, a comparator for comparing the measured frequency values of said first and second counters, and means for establishing theoretical values for the result of comparison of said measured frequency values, said calculator being operatively associated with said drive means for selectively controlling regulation of said drive means of said friction roller, intervention in said winding operation, and stopping of said winding station as a function of deviations in said comparison result determined by said comparator from said theoretical values determined by said establishing means of said calculator.

17. Apparatus for monitoring and controlling winding operation of a winding station in a textile winding machine according to claim 16, and characterized further in that said calculator is operatively associated with stop means for said winding station for stopping the winding operation thereof.

18. Apparatus for monitoring and controlling winding operation of a winding station in a textile winding machine according to claim 16, and characterized further in that said calculator is operatively associated with a signaling device for transmitting a status signal with respect to winding operation of said winding station.

19. Apparatus for monitoring and controlling winding operation of a winding station in a textile winding machine according to claim 13 or 16, and characterized further in that said comparator comprises means for performing one of adding, subtracting, multiplying and dividing said measured values.

20. Apparatus for monitoring and controlling winding operation of a winding station in a textile winding machine according to claim 13 or 16, and characterized further in that said drive means comprises a controllable drive motor and a motor control device operatively connected therewith and with said electronic calculator.

21. Apparatus for monitoring and controlling winding operation of a winding station in a textile winding machine according to claim 20, and characterized further in that said drive motor is a frequency-controlled asynchronous motor and said motor control device is a frequency converter.

22. Apparatus for monitoring and controlling winding operation of a winding station in a textile winding machine according to claim 20, and characterized further in that said drive motor is a phase-angle-controlled asynchronous motor and said motor control device is a phase-angle control.

23. Apparatus for monitoring and controlling winding operation of a winding station in a textile winding machine according to claim 13 or 16, and characterized further by rotatable bobbin tube carrier elements for rotatably supporting said bobbin, a controllable brake device being connected to one said carrier element and to said electronic calculator.

24. Apparatus for monitoring and controlling winding operation of a winding station in a textile winding machine according to claim 23, and characterized further in that said calculator is adapted for actuating said brake device when winding operation of said winding station is stopped.

25. Apparatus for monitoring and controlling winding operation of a winding station in a textile winding machine according to claim 23, and characterized further in that said calculator is adapted for actuating said brake device when said comparison result determined by said comparator is at least approximately steady and coincides at least approximately with an applicable one of said theoretical values.

26. Apparatus for monitoring and controlling winding operation of a winding station in a textile winding machine according to claim 14 or 17, and characterized further in that said calculator is adapted for automatically actuating said stop means when said comparison result is at least approximately steady and one of the following conditions exists: (a) said comparison result coincides at least approximately with a predetermined final value, and (b) said comparison result deviates from an applicable one of said theoretical values by a greater-than-tolerable value.

27. Apparatus for monitoring and controlling winding operation of a winding station in a textile winding machine according to claim 13 or 16, and characterized further in that said calculator comprises a counter for counting the number of revolutions of said friction roller and a theoretical value setting means for setting a relationship between said comparison result and said number of friction roller revolutions as a function of at least the parameters of strand type, stength and winding density, and said calculator is adapted for actuating one of the following control operations when said comparison result is at least approximately steady and said set relationship between said comparison result and said number of friction roller revolutions is not met:

(a) actuating a stop means for stopping winding operation of said winding station, (b) actuating a signaling device for signaling the existence of an abnormal winding condition, and (c) actuating a strand tensioning device for generating strand tension for braking said strand.

28. Apparatus for monitoring and controlling winding operation of a winding station in a textile winding machine according to claim 13 or 16 and characterized further by a control device for controlling a return speed of said bobbin during correction of a strand break, said calculator being operatively connected with said control device for controlling said return speed according to one of the last-applicable one of said theoretical values and an actual value of said comparison result from which a theoretical value may be formed.

* * * * *